United States Patent [19]

Pitre

[11] Patent Number: 4,531,727

[45] Date of Patent: Jul. 30, 1985

[54] WEIGHT LIFTING EXERCISE DEVICE

[75] Inventor: John H. Pitre, Honolulu, Hi.

[73] Assignee: Queststar, Eugene, Oreg.

[21] Appl. No.: 170,106

[22] Filed: Jul. 18, 1980

Related U.S. Application Data

[63] Continuation-in-part of Ser. No. 113.210, Jan. 18, 1980, abandoned, which is a continuation of Ser. No. 846,794, Oct. 31, 1977, abandoned.

[51] Int. Cl.[3] ..... A63B 21/06

[52] U.S. Cl. ..... 272/117; 272/143; 272/130

[58] Field of Search ..... 272/117, 118, 130, 116, 272/DIG. 1, 93

[56] References Cited

U.S. PATENT DOCUMENTS

| | | | |
|---|---|---|---|
| 2,918,282 | 12/1959 | Waterval | 272/117 |
| 3,193,288 | 7/1965 | Le Vell de Spain . | |
| 3,451,271 | 6/1969 | Knoblauch . | |
| 3,984,102 | 10/1976 | Evans | 272/130 |
| 4,257,590 | 3/1981 | Sullivan et al. | 272/117 |

FOREIGN PATENT DOCUMENTS

| | | |
|---|---|---|
| 1428827 | 11/1968 | Fed. Rep. of Germany . |
| 2400403 | 8/1975 | Fed. Rep. of Germany . |
| 2643044 | 3/1978 | Fed. Rep. of Germany . |
| 455279 | 5/1913 | France . |
| 2126894 | 10/1972 | France . |
| 2348717 | 11/1977 | France . |
| 47045 | 2/1909 | Switzerland . |
| 1326263 | 8/1973 | United Kingdom . |

*Primary Examiner*—Richard J. Apley
*Assistant Examiner*—William R. Browne
*Attorney, Agent, or Firm*—Klarquist, Sparkman, Campbell, Leigh & Whinston

[57] ABSTRACT

An exercise device has an outer tank containing a supply of liquid and an inner container with mechanism for receiving a portion of the liquid from the tank when the container is in a first position and mechanism for discharging the liquid from the container at a controlled rate when in a second position. The inner container is connected to an elongated member that extends out of the tank and may be pulled upon by the user. A conduit may supply liquid under pressure selectively to the liquid container, in response to user demand as indicated by activation of a switch, and the liquid may then drain from the container through the same or a different conduit, to the original reservoir or a drain; and in this embodiment the container need not enter the tank or reservoir. A pair of spreadable arms may be hinged or pivoted to the device and connected via mechanical linkage or cable to the weight container for biasing the arms into separated position for push-up exercises, and an overhead T-bar may provide support for laterally spaced hand pulls suited for chest exercises.

25 Claims, 13 Drawing Figures

WEIGHT LIFTING EXERCISE DEVICE

CROSS REFERENCE TO RELATED APPLICATION

This is a continuation-in-part of copending U.S. patent application Ser. No. 113,210, filed Jan. 18, 1980, now abandoned, which is a continuation of U.S. patent application Ser. No. 846,794, filed Oct. 31, 1977, now abandoned.

BACKGROUND OF THE INVENTION

1. Field of the Invention

The invention relates to amusement and exercise devices. Specifically, the invention is an apparatus for weight lifting exercise in which the weight is automatically increased or reduced during the repetitions of an exercise.

2. Description of the Prior Art

Body building requires that man exercise his muscles against an opposing force. One of the most common ways to accomplish the required exercise is to lift a heavy weight such as a barbell or the like. This form of exercise may be referred to as isotonic exercise, as the muscle acts against a constant weight. Ordinarily, the muscle is repeatedly exerted against the weight, accomplishing the identical movement with each repetition.

Well known isotonic exercise devices employ weight units of cast iron or other solid, dense material or employ resistance via pnumatic cylinders. Different numbers of the weight units may be selectively engaged by the user, for example by stringing the units on a barbell or lifting cable, and the user then performs as many exercise repetitions as he is able with the preselected weight.

It is known that the muscles tire with each repetition of an exercise, requiring that the weight selected for a movement be less than the maximum capacity of the muscles involved so that many repetitions can be accomplished, with the muscles eventually tiring to the point that they can no longer repeat the movement at the preselected weight. This method of body building is inefficient, as it requires that the muscles work at far less than full efficiency during the early repetitions of the movement, during which time the muscles are merely tiring themselves to the point where truly efficient body building can begin.

Serious body builders have attempted to eliminate the initial period of inefficient exercise by placing as much weight on, for example, a barbell as the muscle can lift in a single movement. Then, after each repetition or short series of repetitions, assistants at each end of the barbell will quickly remove one of the weight units, thereby reducing the total weight as the muscles tire, allowing the body builder to continue the same movement with efficiency. The inconvenience of this system is evident, but it also is dangerous, as the assistants must closely coordinate their efforts in order to avoid an unbalanced barbell in the hands of the body builder.

Isometric exercise employs the muscles against an unmoving object, allowing the muscles to apply full force for as long as the body builder desires. Although the muscles may tire, the exercise is uninterrupted, as no movement is involved. Isometric exercising devices are known that mechanically increase the force being opposed by the muscles, thereby forcing the muscles to exert their maximum effort. At some point, the force exerted by the device may overcome the muscle. Serious injury has resulted to persons using such isometric devices. U.S. Pat. Nos. 3,731,922 and 3,614,097 to Jungreis relate to variable force isometric devices. Such devices are not generally suited for isotonic exercise.

The present invention relates to an isotonic exercise apparatus that safely varies the mass of a dead weight to compensate fo muscle warm-up and fatigue.

SUMMARY OF THE INVENTION

The invention is a weight lifting device having a liquid storage tank and a moveable liquid container, the latter receiving liquid from the former and generally discharging the received liquid back into the storage tank. Moving means such as an elongated rope or cable is attached to the container for lifting and lowering the container as a user exercises. In an embodiment wherein the container moves within the storage tank, the tank is equipped with pulley means to guide the elongated member over the top of the tank. In an embodiment wherein the storage tank and liquid container do not share common space, a separate support framework carries the weight container, and the storage tank is connected to the container by a flexible conduit through which the liquid weight medium is pumped or flows by gravity. Laterally moveable arms may be pivoted to the support framework at one end and moveable through an arc at the other, and such arms are further connected to the framework in such a manner that they are biased laterally, permitting the variable weight of the continer to vary the force necessary to move the arms in a chosen manner. The same arms may have pivot shoulder pads to cushion during leg extension exercises. An overhead T-bar may support a pair of widely spaced hand grips for chest exercises.

The main object of the invention is to create a weight lifting device that actually increases or reduces the dead weight being used in an exercise device as the exercise continues. For this purpose, a flowable liquid is placed in a container that in turn is lifted by the user, either directly or indirectly through an elongated member attached to the container. The liquid flows into and out of the container during the lifting process, for example through one or more holes in the container or under power of a pump, thereby increasing or reducing the container weight and reducing or increasing the strength needed for the user to continue his exercise.

Another object of the invention is to increase or reduce the weight being used for exercise at a constant rate. For this purpose, the liquid container may have a constantly or intermittently operating discharge pump, or in the simplest embodiment, may have a vertical series of holes in the container side of proper size and relative spacing for a constant rate of liquid discharge. A single hole in the form of a vertical slot or round hole may also accomplish the discharge function.

A further object of the invention is to create a weight lifting device that can be shipped and assembled without the need for handling many hundred pounds of precast weights. This object is accomplished by using a readily available and disposable liquid such as water for the weight medium. The essential hardware needed may be relatively light in weight, comprising a tank, a bucket, and a rope, while the weight-giving material may be added at the location of use, for example by filling the tank through a hose. Similarly, the tank can be drained before the device is moved.

DESCRIPTION OF THE PREFERRED EMBODIMENT

Figure 1:
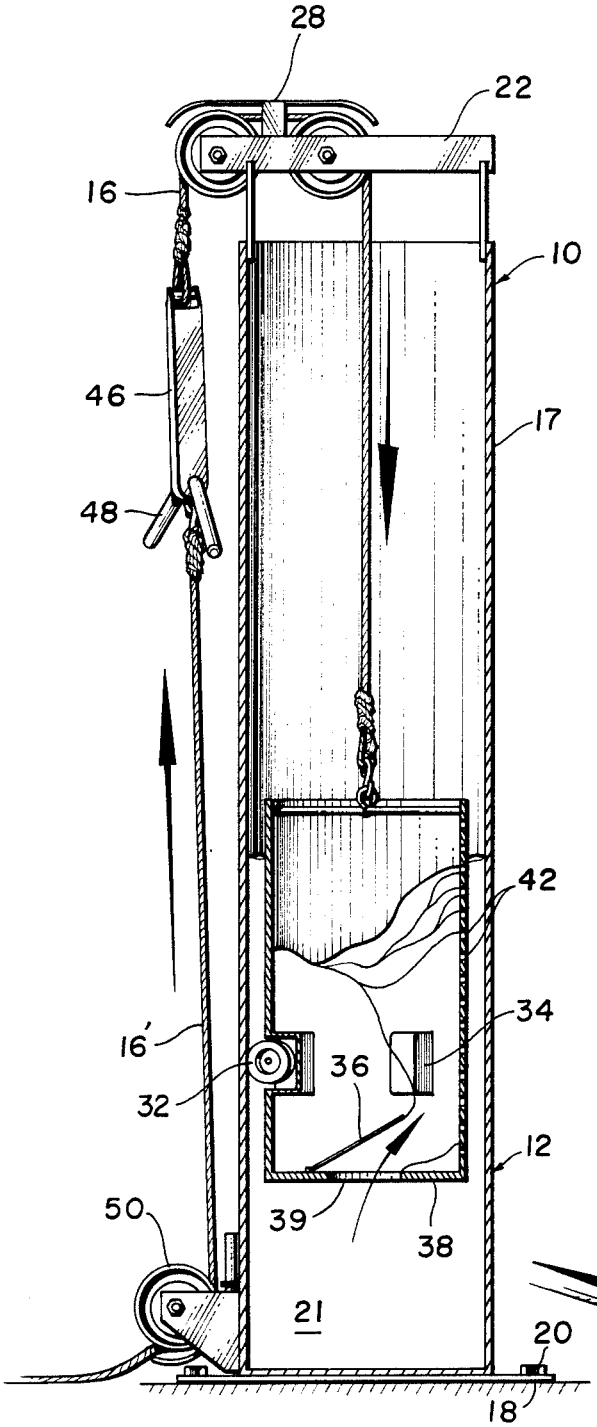
FIG. 1 is a vertical cross-sectional view of the invention with the weight bucket in position to receive liquid medium.

The weight lifting apparatus 10 consists of three primary elements including storage tank 12, moveable container means such as weight bucket 14, and tension line 16. These components are intended for use with a fluid medium such as a liquid.

Storage tank 12 is a reservoir that holds an inactive supply of the liquid medium in readiness for use by a person employing the apparatus 10. In the drawings, tank 12 is a vertical cylinder 17 sealed at the bottom by base plate 18, which may extend radially outwardly from the cylinder as far as desired to provide a secure footing. Plate 18 may also be fastened to the floor under tank 12 by any conventional devices, such as bolts 20, FIG. 3. The preferred liquid medium contained within the tank is water, due to its ready availability. Any other liquid may also be used in tank 12, with modification of bucket 14 being made to compensate for differences in viscosity, as described below. The tank may be constructed of metal, plastic, or any other material having suitable strength. To prevent possible corrosion between a metal tank and contained water, the water may have a corrosion preventative added, such as antifreeze, or the tank itself may be treated by plating or paint.

Although the illustrated tank is a cylinder, any shape may be used. The height of the tank should be sufficient to contain the stored liquid medium 21 in a lower portion thereof, for example the lower one-fourth, thereby leaving sufficient room above the liquid for the bucket 14 to be moved on tension line 16. A liquid storage space of fifty gallons has been found suitable for the heaviest applications supplying over three hundred pounds of useable dead weight, while any smaller volume may be used as desired.

The top of tank 12 may be open, as shown in the drawings, or a cover may be employed with a suitable passageway allowing line 16 to exit the tank without obstruction. Support framework 22 extends above the tank and carries guide means such as pulleys 24 and 26 for supporting line 16 as it passes over the top end of cylinder 12. Guard 28 overlies the pulleys and aids in retaining line 16 on the pulley wheels.

Figure 2:
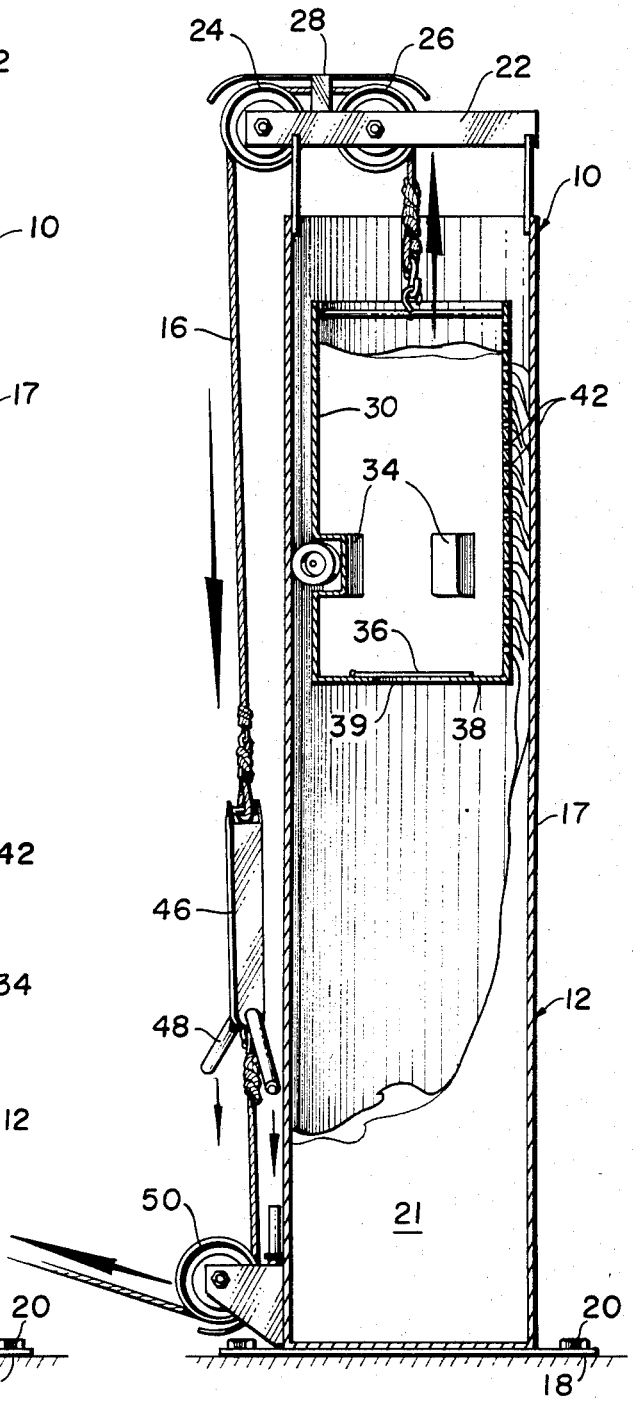
FIG. 2 if a vertical cross-sectional view of the invention with the weight bucket in position to discharge liquid medium.

Weight bucket 14 fits coaxially within cylinder 12 and is vertically moveable therein. Cylindrical side wall 30 is of smaller diameter than cylinder 17, and a plurality of guide wheels 32, best shown in FIGS. 1 and 2, are attached to the exterior of wall 30 in housings 34 to both guide and space the wall 30 from cylinder 17 as the bucket moves axially vertically within tank 12. Fluid intake means such as flapper valve 36 may be carried by or on bottom wall 38 to automatically admit liquid to bucket 14 through intake opening 39 when the bucket falls against the stored liquid 21 in the lower portion of tank 12, as illustrated in FIG. 1. Valve 36 may be pivotally mounted on the upper surface of wall 38 so that it opens upwardly only and seals opening 39 against loss of liquid within bucket 14 when the bucket is raised above the level of stored liquid 21, as shown in FIG. 2.

Bucket 14 also has fluid outlet means for draining liquid from the bucket to the tank at a predetermined, controlled rate. It is generally desirable to discharge liquid from bucket 14 at a constant rate for linear weight reduction. A series of drain holes 42 in vertical wall 30 can be spaced to accomplish a linear loss of liquid weight from the bucket. The exact size of the holes and spacing between adjacent holes can be determined empirically for any shape of bucket 14 and desired rate of weight loss, but it will be generally true that the holes are more closely spaced near the bottom of the bucket than near the top, as the weight of water in a full bucket urges faster drainage than the weight of water in a partially empty bucket.

While the illustrated embodiment has holes 42 only in the exterior side wall 30, the bucket may have similar holes elsewhere. For example, a central axial stand pipe (not shown) with holes therein could be employed, or multiple vertical rows of holes could be formed in wall 30. If desired, fluid intake 39 may be eliminated and holes 42 may admit the liquid, as shown in FIG. 1, in addition to discharging the liquid, as shown in FIG. 2.

Tension line 16 is connected to bucket 14, for example to brackets 44 attached to the bucket. The line preferably is coaxial with the axis of cylinder 17 as it runs vertically upwardly from the bucket, then passing over pulleys 26 and 24 and terminating at a point exterior of tank 12. A counterweight 46 at the outer end of line 16 may perfectly compensate for the empty weight of bucket 14. Arms 48 may also be attached to the exterior end of line 16, providing an initial grasping device for the user of the apparatus. If desired, line 16' may extend from the counterweight 46 and arms 48 downwardly and around a lower pulley 50 attached to tank 12 or to the floor. Line 16' may be tensioned more easily by horizontal force, while line 16 is tensioned more easily by vertical force. Various arms, harnesses for different body limbs, or like known gripping devices may be attached to the exterior end of line 16' or line 16 to enable the user to accomplish a vast array of exercise movements.

In operation, the apparatus may be utilized in any room or structure having sufficient strength to support the tank plus its contained liquid, i.e. water. The tank may be loosely placed on the floor, or it may be bolted down to resist tipping. Ordinarily, the weight of stored liquid 21 causes the tank to resist tipping regardless of horizontal force generated during use.

Figure 3:
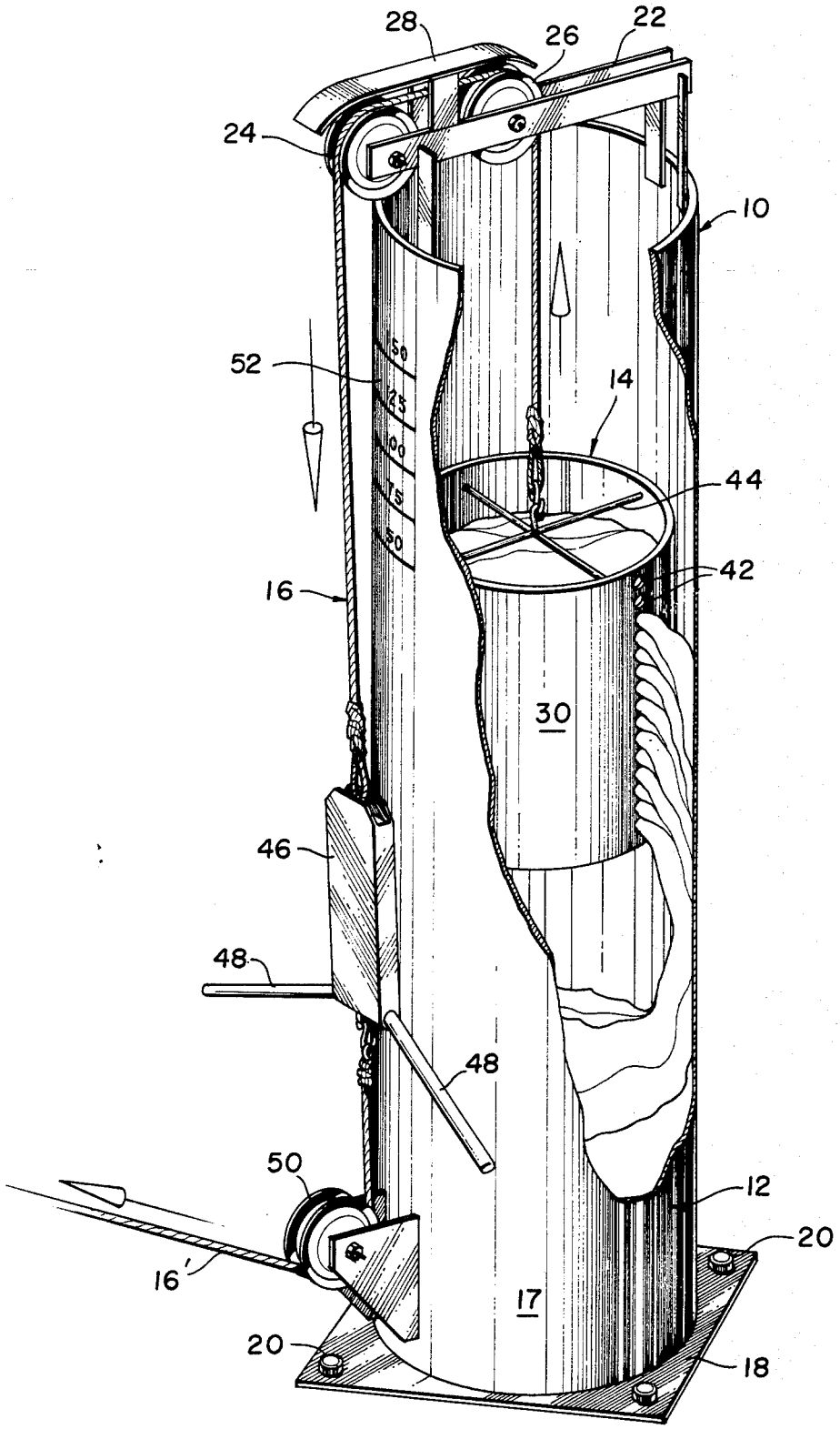
FIG. 3 is an isometric view of the invention in partial section.

As shown in FIG. 1, the user first lifts counter-weight 46 to lower bucket 14 into the stored water, where the bucket tends to partially submerge due to its own weight. A scale 52 on the exterior of tank 12 may indicate the proper height to which counterweight 46 must be raised in order to obtain a desired weight of water in bucket 14, as shown in FIG. 3. Water enters the bucket through intake 39 as flapper 36 yields to the force of the water and opens. Water may also enter through holes 42. When the desired quantity of water has entered the bucket, the user commences his exercise by pulling on line 16 or 16', raising the bucket out of the stored water, as shown in FIG. 2. Immediately the weight of the water forces flapper valve 36 shut. As the user performs repetitions of his chosen exercise, the bucket travels up and down in cylinder 17 within the free space above any remaining stored water, for example at least three-fourths of the height of the cylinder. In practice, few if any movements would use more than four feet of linear travel, creating no substantial concern that the bucket would inadvertantly dip into the stored water during repetition of a single movement, as a representative cylinder 17 may have a height of eight feet or more, although shorter cylinders may be used.

Throughout the time that the bucket is above the level of stored water 21, the water within the bucket will be draining through holes 42, slowly reducing the total dead weight being moved during each repetition. The water draining from the bucket returns to the stored water 21 in the bottom of the cylinder for furture use, as illustrated in FIG. 2. The user may select the weight of water that approximates his maximum ability for the first repetition of the movement, and for each successive repetition the weight of water in the bucket will be smaller, corresponding to the reduced capacity of the user's muscles due to fatigue from prior repetitions. No impass in movement or damaging strain can occur as with fixed weights, and the user is able to continue his repetitions beyond the number ordinarily possible with fixed weight. Also, because the weight reduction in the bucket is constant, the apparatus is self-compensating for incorrect estimates of initial bucket weight. If the bucket is initially too heavy, the slower speed of the initial repetitions will allow greater weight loss per repetition, while an initially too light bucket can be moved more rapidly, accomplishing a greater than usual number of repetitions with less than the usual weight loss per repetition.

One of the great advantages of this apparatus as compared to conventional cast weight exercise devices is that the weight giving liquid can be supplied at the point of use and need not be transported with the apparatus. This results in greatly reduced shipping and handling problems, as well as far lower cost to obtain equivalent dead-weight exercise capability. It will also be appreciated that this weight lifting apparatus is safer than cast weight systems. If the weight is dropped, the bucket merely splashes into a pool of water that acts as an energy sponge to absorb the shock and ease the impact on the bucket and tank.

A great many variations of the apparatus are possible, especially in the shape and size of the tank and bucket, as well as in the mechanism used to control inflow and outflow of water from the bucket. For example, a pump within the bucket could expel the water, or a pump in the tank could fill the bucket in response to activation of a switch located in the bucket path near the bottom of the tank. Instead of vertical holes in the bucket side, a continuous slot of fixed or variable width could be used, or covering flaps could seal selected holes 42 to allow variation in draining rate.

Figure 4:
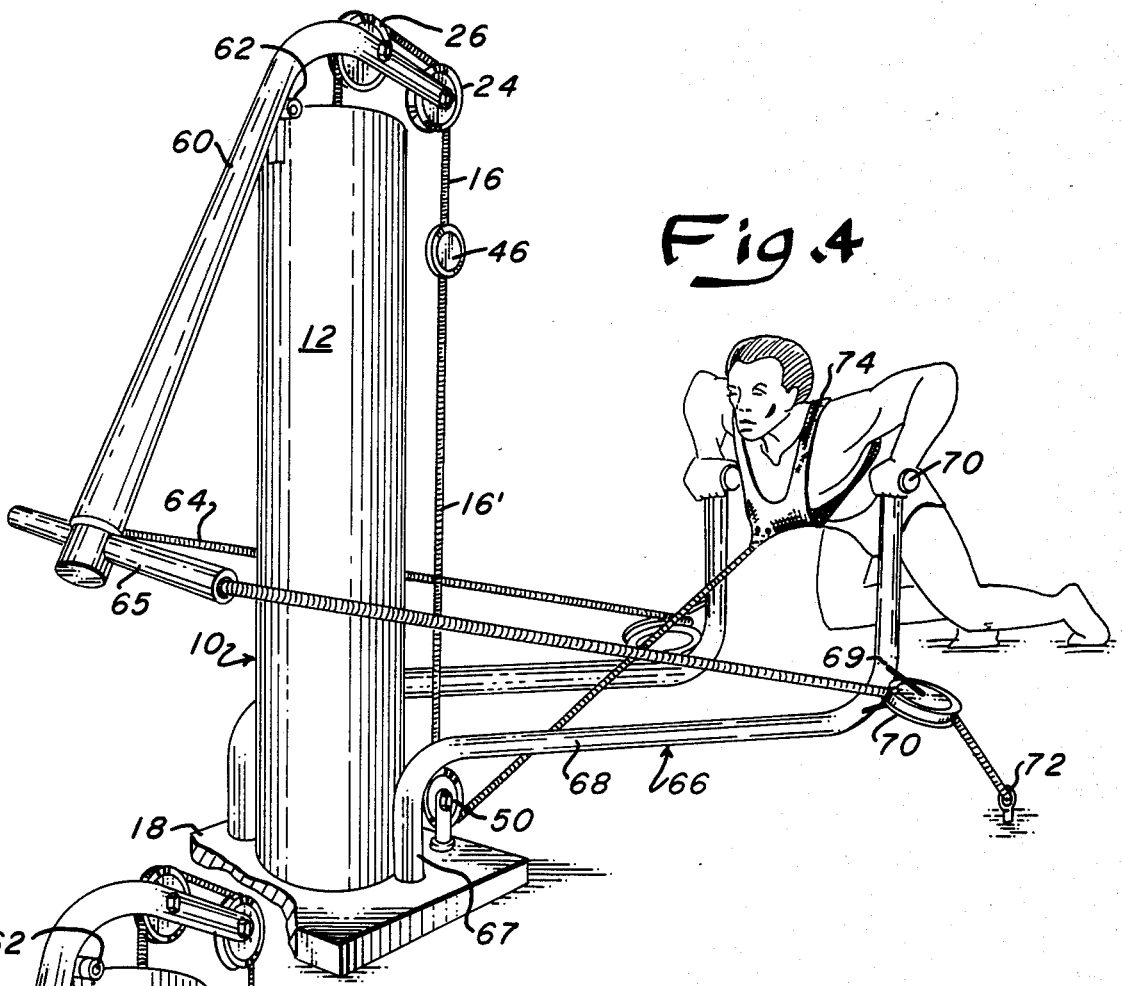
FIG. 4 is an isometric view of a modified embodiment of the invention.
Figure 5:
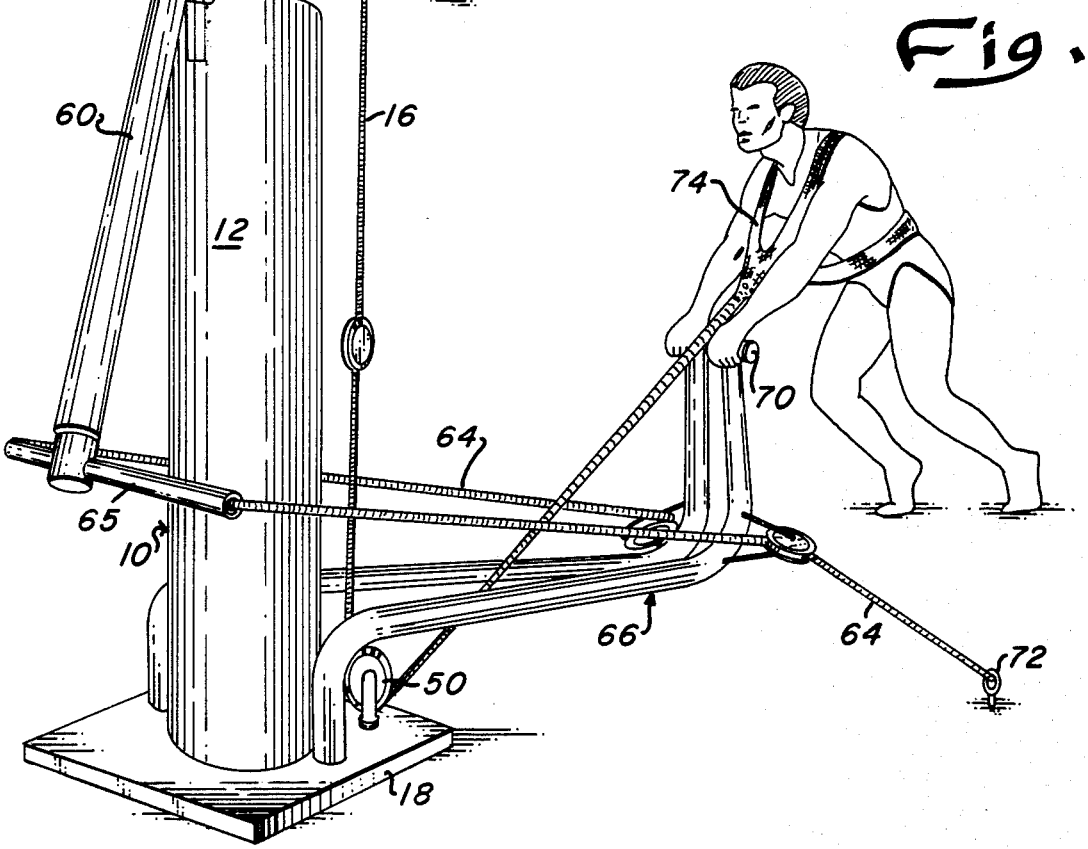
FIG. 5 is another isometric view of the embodiment of FIG. 4.

In the embodiment of FIGS. 4 and 5, the apparatus 10 has been modified by the substitution of pivotally mounted lever 60 for pulley support framework 22. Lever 60 carries the guide means for tension line 16 at a first end thereof, for example the upper end that supports pulleys 24 and 26. The lever is pivotally supported in an appropriate position to retain pulleys 24 and 26 in the approximate positions shown in FIGS. 1–3. For example, the pulleys are on spaced parallel axes in an approximately horizontal plane with each axis being transverse to the lever 60. Pulley 24 is closest to the tip of the upper portion of lever 60, while pulley 26 is closest to hinge 62 connecting the lever to the upper lip of tank 12. Tension line 16 is connected to weight bucket 14 and extends upwardly therefrom following the approximate vertical axis of tank 12 to a position slidably engaging the upper end of the lever, for example by engaging the groove of pulley 26 that is approximately tangent to the axis of the tank 12. The tension line then passes over pulley 26 and pulley 24 and downwardly outside the tank to be pulled upon by the user.

While hinge 62 is the preferred attachment of lever 60 to the apparatus 10, other support means could be employed to similarly hold the lever 60 in an appropriate position over tank 12 and weight bucket 14. For example, a support bracket could pivotally carry the lever on an axis coaxial with the axis of pulley 26, thereby maintaining pulley 26 in precise position over the weight bucket 14 with line 16 on the vertical axis of the tank. However, it is preferred that both pulleys be on one side of the pivotal mounting of the lever so that the full weight of the pulleys, line 16, weight bucket 14, and counterweight 46 are applied on one end of the lever. The small amount by which line 16 deviates from the axis of tank 12 because of movement of pulley with lever 60 has proven to be unimportant.

The second or lower end of lever 60 has elongated connecting means such as cables 64 attached thereto, for example to the ends of cross-bar 65 that extends transversely to the plane of lever pivotal motion near the lower tip of the lever. While the upper end of the lever is approximately horizontal over the top of tank 12, the lower end preferably angles downwardly at an acute angle to the vertical axis of the tank, bringing the cross-bar to a level where it moves with a substantial horizontal component as the lever pivots on hinge 62.

A pair of spreadable arms 66 has been added to the apparatus 10 to provide supports against which a user of the apparatus can apply force. In the illustrated form, each arm 66 is mounted for pivotal movement in a horizontal plane and extends generally away from tank 12 on the side of the tank opposite from the lower end of lever 60. The vertical end portion 67 of each arm is pivotally connected to base plate 18 for movement on a vertical axis; mid portion 68 extends outwardly from tank 12, and outer end portion 69 extends upwardly and terminates in hand engageable grip 70.

A cable 64 extends from each end of cross-bar 65 past tank 12, which is narrower than the length of the cross-bar, into engagement with a portion of each arm 66 remote from the pivotal axis of the arm. In the illustrated embodiment of FIGS. 4 and 5, the cable passes around a pulley 70 attached to each arm and then extends laterally of each arm in the direction away from the opposite arm of the pair, finally being anchored to the floor by suitable anchoring means 72, for example an eye-bolt. A cable 64 may run from each end of cross-bar 65 to one of the arms 66, or a single cable may pass through the length of the cross-bar and extend at each of its opposite ends to one of the arms. The cable 64 may be directly attached to each arm 66 if the position of the arms allows the cable to apply a spreading force to the hand grip area in response to movement of cross-bar 65 away from tank 12.

In operation, a user wears a body harness 74 connected to line 16', which extends from the harness, around pulley 50, to counterweight 46. Line 16 then connects the counterweight to the weight bucket 14 as described above. The user is then able to perform an exercise movement such as the standing pushup against the hand grips 70. Pulleys 24 and 26, lines 16 and 16', weight bucket 14, and counterweight 46 have their weights applied against the upper end of the lever, thus tending to pivot the upper end downwardly at hinge 62, urging the lower end of the lever away from tank 12 and creating a tension on cable 64, which results in a laterally outward force on the arms 66. When the user applies tension to the lines 16, 16' to lift the weight bucket and water contained therein, increased downward force is applied to the upper end of lever 60, forcing the lower end of the lever away from tank 12 with an increased force directly proportional to the weight of water in the weight bucket.

The individual performing the exercise movement not only must oppose the weight within the weight bucket by direct extension of his arms, but also opposes the weight by bringing his hands together in opposition to the spreading force applied to the pivot arms 66 by lever 60. A comparison of FIGS. 4 and 5 will illustrate the desired exercise movement. The two-fold motion of a push-up plus bringing the hands together results in exceptionally complete development of the chest and shoulder area.

The illustrated shapes and arrangement of the lever 60 and pivot arms 66 are subject to various modifications without altering the function of the apparatus 10. For example, the arms 66 could be pivotally connected to the ground remote from tank 12 and be pivotal in a vertical plane. The location of pulley wheels 70 on arms 66 may be altered to adjust the leverage with which the pair of arms is urged apart. Similarly, the length of lever 60 and the relative position of hinge 62 on the lever are subject to change to suit individual preferences.

Figure 6:
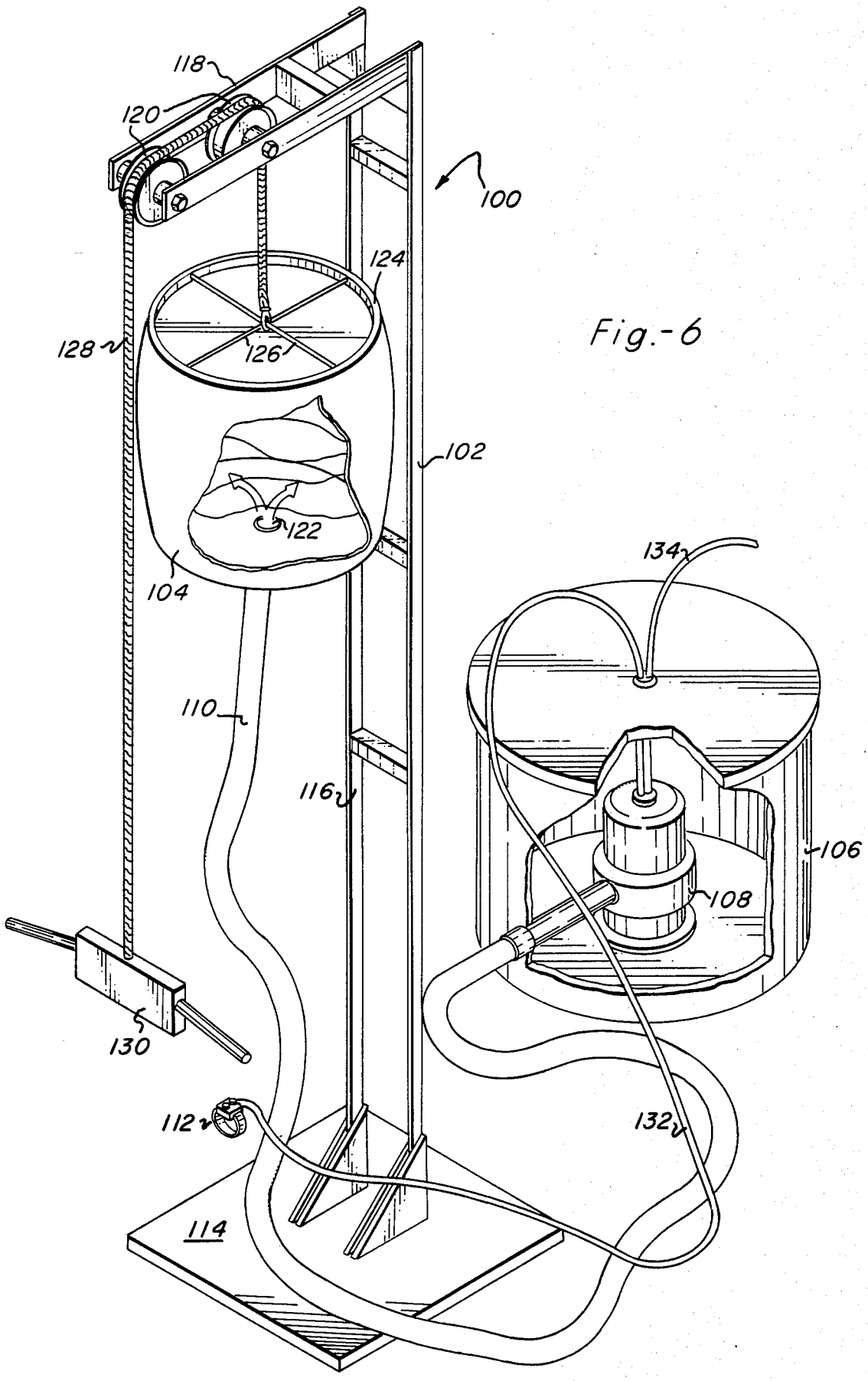
FIG. 6 is a perspective view in partial section of a further embodiment of the invention.

According to the further embodiment of FIG. 6, an exercise apparatus 100 is constructed with a support framework 102 capable of carrying the weight of a container 104 suspended from the framework. A liquid supply means such as tank or reservoir 106 having pump 108 associated therewith is connected to the container 102 by conduit 110. An activating means such as switch 112 controls the operation of the pump.

The framework 102 differs from previous embodiments in that it is not directly associated with a tank means containing the liquid supply. Rather, the framework is a primary support means for the container 104 and is therefore constructed in a suitable manner to carry the maximum weight of the container when filled with the desired liquid from reservoir 106. The framework is generally constructed with a base 114 having a superstructure 116 rising therefrom and connected to a support arm 118 at the top of the superstructure. The support arm may include friction reducing means such as pulleys 120.

The container 104 is adapted to receive and discharge a liquid medium such as water. For this purpose, at least one port 122 is present in the container. In addition, the container may have a second opening such as an open top defined by rim 124 for venting the container to facilitate the receipt and discharge of liquid through port 122. Appropriate braces 126 or other fastening members may be associated with the container as an attachment means for connection to a flexible elongated tension member such as cable 128 having a hand grip 130 or other user engageable means at the opposite end thereof.

Liquid reservoir 106 is one example of a suitable source of fluid weight medium to be delivered to the container 104 upon demand by a user. This reservoir does not necessarily receive any portion of the container 104 during the course of continued exercise, but may be remotely located with respect to the container 104 and framework 102. Conduit 110, which is flexible and elongated so that it is capable of following the motion of the container 104, extends between the reservoir and the container port 122. Pump 108 acts as valve means that selectively supplies liquid from the reservoir to the container via the conduit. This pump may be a sump pump, or it may be located outside the reservoir, either between the reservoir and container at some point in the length of the conduit, or in the container itself. This pump is preferred to be of the type that directs liquid in one direction when activated but does not seal against the reverse flow of liquid through the pump when the pump is idle. Such pumps are readily available and need not be described in greater detail. Alternatively, a pump capable of selective operation in either of two directions may be employed whether or not liquid can back-flow through the pump when the pump is idle. Selective operation of either type of pump is achieved through operation of switch 112, illustrated to be a micro switch mounted on a finger engageable ring and connected by cord 132 to the pump. The pump is, in turn, connected by cord 134 to a power source.

The operation of the exercise device is similar to that of the previously described embodiments in that the user raises and lowers the container 104 through tension applied to the cable 128. The volume of liquid in the container is variable according to the user's desires. Liquid is added to the container by activating pump 108 to supply such additional liquid through conduit 110 and port 122. When the pump is idle, liquid backflows from the container to the reservoir through the conduit, thereby reducing the effective weight in the container. If the pump is of the type capable of operation selectively in either of two directions, the weight reduction may be achieved by reverse activation of the pump.

The embodiment of FIG. 6 maintains the advantage of a closed circulation system wherein the same liquid is reused as the weight medium. However, the reservoir 106 need not be exclusively associated with the container 104, as one reservoir could serve several containers 104, each container having its own pump. Although the advantage of reuse of the liquid medium would be lost, the reservoir 106 could be replaced by a different source of liquid, such as a pressurized water supply; the switch 112 would then be used to control a valve or pressure restraining device; and liquid back-flowing from the container would be discharged into a drain or other disposal area.

Figure 7:
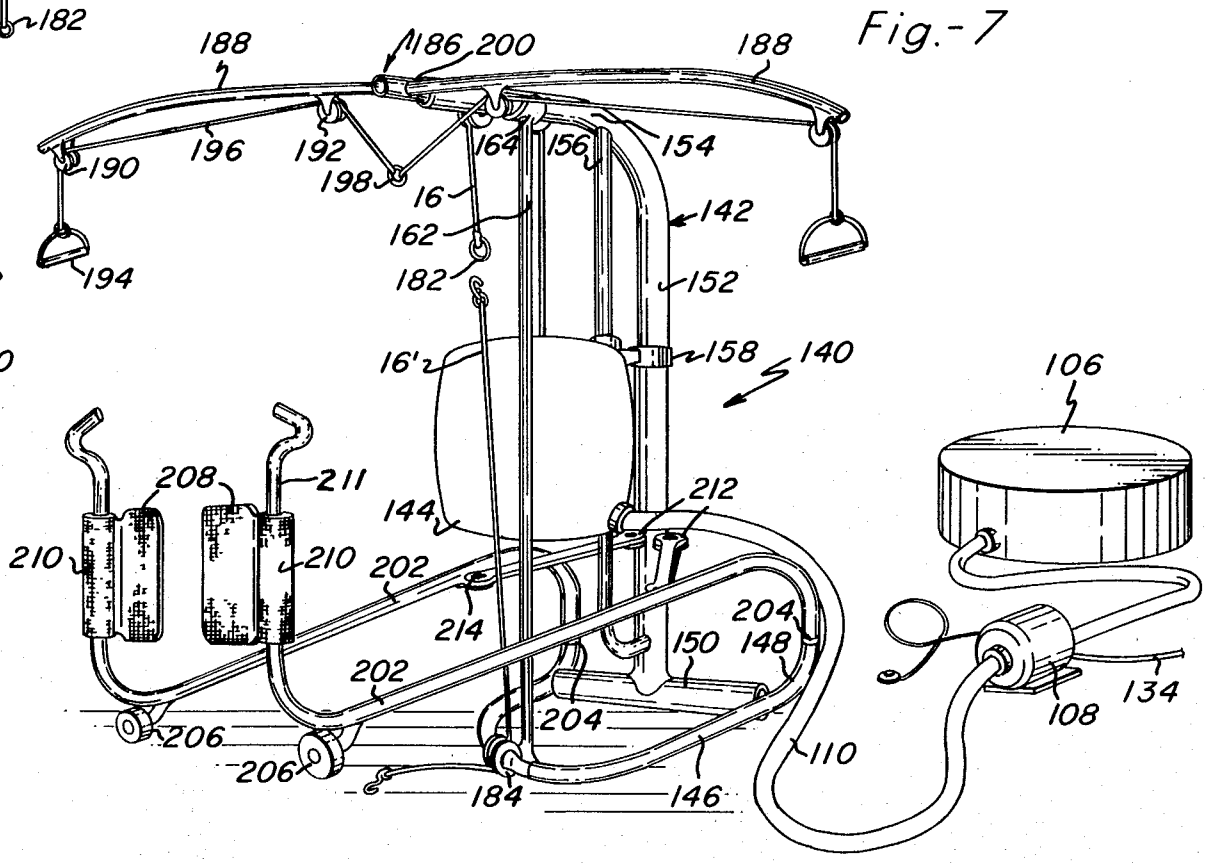
FIG. 7 is a perspective view of another embodiment of the invention.

The embodiment shown in FIG. 7 combines features previously described with a framework permitting a wide range of exercises. The apparatus designated 140 employs a support framework 142 carrying a weight container 144 having an associated reservoir 106 for supplying fluid to the container, such as through conduit 110 under the influence of pump 108, which in this embodiment is illustrated to be inline with the conduit. The support framework 142 is provided with a base having platform portion 146 for maintaining the apparatus in stable position on a resting surface. The platform is formed in a U-shaped configuration having the closed end of the U facing the front or exercise station of the apparatus and underlying the weight container 144. The U-shaped platform portion 146 may be formed from metal tubing having ends 148 extending upwardly at the open end of the U for pivotal connection to spreadable arms. The open end of the U-shaped platform portion may be closed by a cross-member 150 pivotally connected to each side of the U-shaped platform portion for movement about the longitudinal axis of the cross-member extending between the pivoted ends 151. The platform portion and cross-member together define a closed base capable of supporting a substantial weight in the weight container.

The support framework includes a superstructure having upright member 152 joined to the base for hinged movement, for example with cross-member 150. The connection between the upright and cross-members may therefore be substantially unyielding such as a welded junction, with the upright gaining lateral stability by virtue of the lateral support provided by the portion of the cross-member 150 at either lateral side of the junction. The upright member 152 may be formed from metal tubing that is curved forwardly near the top of the upright to define a top bar 154 extending over the front of the U-shaped base. The top bar supports the weight container for movement during exercise.

Because the upright member 152 is capable of movement in the front to rear direction with the pivotal movement of the cross-member, the weight container is supported from the support framework in a manner that avoids random swinging of the container 144 during movement of the superstructure. Means for preventing swinging of the container 144 include a container guide rail 156 jointed to the support framework at least at one end, such as to the top bar 154, and extending generally parallel to the upright member 152. In addition, the guide rail may be joined to the upright member near the base. The container 144 is slidably joined to the guide rail and the upright by at least one container guide arm 158 having guide rings 160 that engage the guide rail and the upright member. Optionally, a pair of such guide arms, one near the top of the container 144 and one near the bottom, may provide smooth guidance for the weight container along the guide rail and upright member regardless of whether the rail and upright member are truly vertical. The weight container is thus stabilized against random swinging due to tilting or vibration in the support framework, assuring that the center of gravity of the apparatus 140 remains over the platform portion of the base. Because the superstructure is capable of movement about the axis of the cross-member 150 running between pivoted ends 151, means are provided to support the weight container both forwardly and rearwardly of its suspension point from the top bar 154. Upright member 152 provides such rearward support, and top bar support arm 162 provides the forward support. The support arm preferably is connected to the base at the forward end of the platform portion and extends upwardly therefrom to engage the top bar in saddle 164 defining the upper end of the arm. The top bar is free to raise above the saddle but is limited in its downward travel by the saddle and arm.

Figure 8:
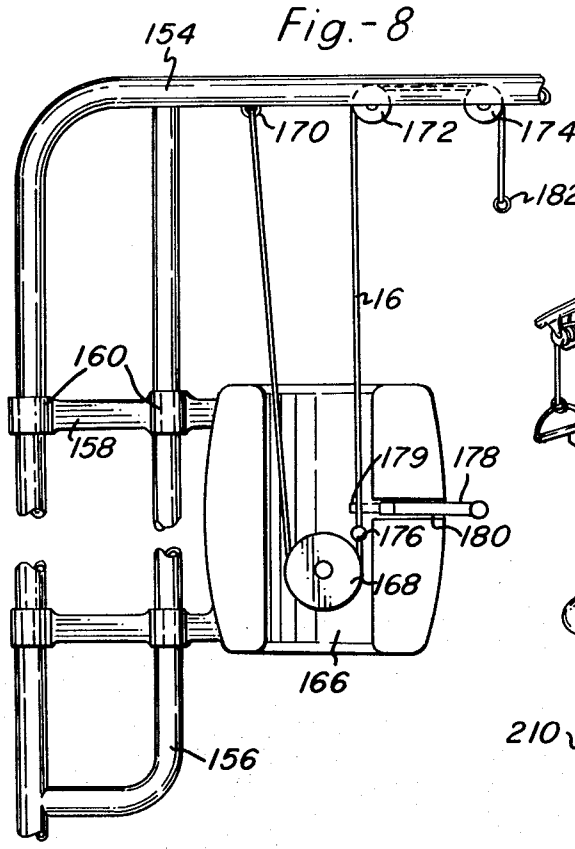
FIG. 8 is a fragmentary view in partial section of a modified weight container.

As in prior embodiments, the weight container is raised and lowered on an elongated member 16, such as a cable. FIG. 8 illustrates a suspension of the container 144 on the member 16 in a manner offering selection of a mechanical advantage in movement of the container. The vertical center of the container 144 defines a hollow core 166 containing a sheave 168 on a horizontal axis. The elongated member 16 is connected to the superstructure at fastening point 170 on the top bar toward the rearward edge of the core 166, relative to the position of the container. The elongated member 16 is strung from the fastening point around the sheave 168 and then over rear and front pulleys 172 and 174, respectively, as shown in FIG. 8. The weight container is thus suspended from a loop of the elongated member. Means for releasably attaching a portion of the loop to the container permit a two-to-one mechanical advantage to be selectively utilized during exercise. An enlarged member such as knob 176 is attached to elongated member 16 at a point past the forward side of the sheave 168 relative to the position of the elongated member when the container is near the bottom of its permissible travel. A slidable locking bar 178 having a forked end 179 engageable about the elongated member 16 is carried in passageway 180 formed by the container wall. When the bar 178 is moved into the container core 166, forked end 179 engages the elongated member and prevents passage of knob 176, thereby permitting one-to-one movement of the container as the elongated member is moved. When the bar is retracted from the container core, the fork disengages the elongated member and no longer restricts movement of knob 176, thereby permitting the elongated member and knob to move about the sheave 168, providing a two-to-one mechanical advantage in the raising or lowering of the container. Other mechanical advantages could likewise be employed by a suitable combination of sheaves, as is generally known.

Figure 12:
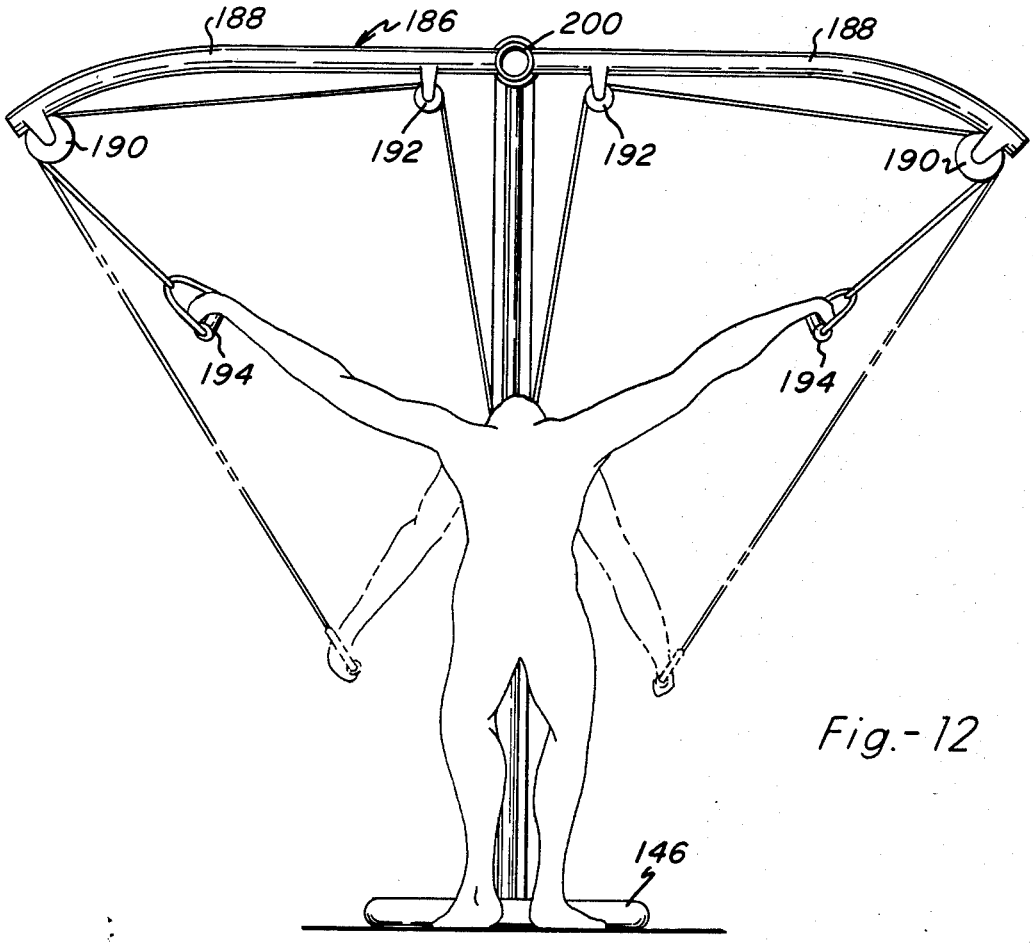
FIG. 12 is a front elevational view of the invention of FIG. 7, showing a chest exercise.

All exercises are performed by pulling the elongated member from its free end, which is provided with a hook-up device such as ring 182. The auxiliary elongated member 16' may be connected to ring 182 and strung around lower pulley sheave 184 at the forward top of the base platform portion 146. In FIGS. 7 and 12, the apparatus is shown in configuration for performing a major chest development exercise, wherein an overhead T-bar 168 having a pair of opposed lateral arms 188 is attached to the free end of the top bar 154 by socketed connected. Each lateral arm 188 carries both an outer pulley 190 near the tip of the arm and an inner pulley 192 near the junction of the arms. A hand grip 194 is carried on cable 196 strung through the outer and inner pulleys of each lateral arm, and the two cables 196 are connected at a common point by a suitable fastener adapted for engagement by auxiliary member 16', for example by a ring 198. Sleeve 200 joins the lateral arms and engages the end of the top bar to support the overhead T-bar for the exercise. FIG. 12 shows the chest movement made possible by the T-bar, wherein the exercisor stands in a slightly crouched forward position with arms spread and engaging the hand grips 194, as shown in solid lines. The exercise is performed by swinging the arms downwardly in a smooth arc, bringing the hands in front of the knees, as shown in phantom; and at the same time the exercisor may slightly increase the degree of forward crouch.

Further unique exercises performable on apparatus 140 are illustrated in FIGS. 9–11 and 13, wherein spreadable arms 202 are pivotally connected to the upturned ends 148 of the platform tubing, defining a pivot point 204 between each arm 202 and the base. Each arm 202 may be provided with a front support such as wheel 206 carrying the arm for arcuate movement at the front end about the pivot point 204. As best shown in FIG. 7, the front end of each arm is substantially vertical, each carrying a shoulder pad 208 mounted on a pivot sleeve 210. The sleeves 210 are rotatable on the arm ends to bring the pads into mutually parallel positions on the inner sides of the arms. Additionally, the pads may be moved to other positions about the arm ends. A suitable stop or latching means such as a set screw or pin may fasten the pads into the position shown in FIG. 7 so that force can be applied against them. Additionally, the arms 202 may comprise individual upper and lower portions at the upright front ends, with the upper portions 211 being rotatably and height adjustably carried in the pivot sleeves, which in turn are carried on the lower arm portions. Each spreadable arm is also connected to the support framework by a link 212 joined to both an arm 202 and the upright member 152 by a pivot joint 214. When the arms are parallel as shown in FIG. 7, the links 212 are approximately at forty five degrees or less to the planes of the arms, angling rearwardly to the upright member.

Figure 9:
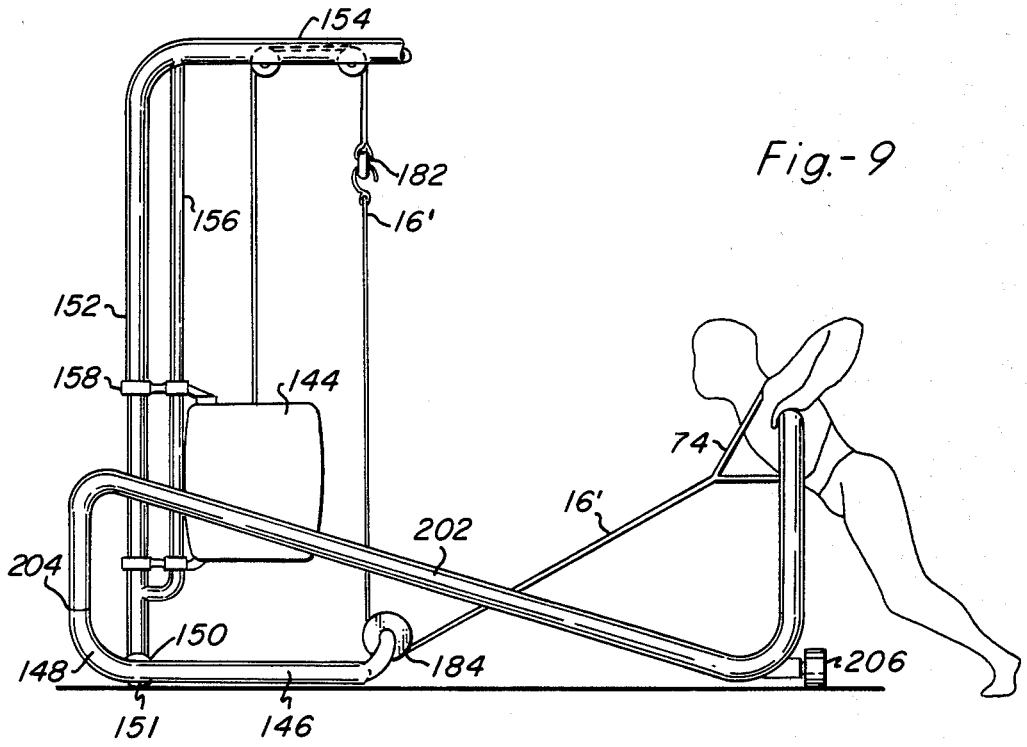
FIG. 9 is a side elevational view of the invention of FIG. 7, showing a push-up exercise.
Figure 10:
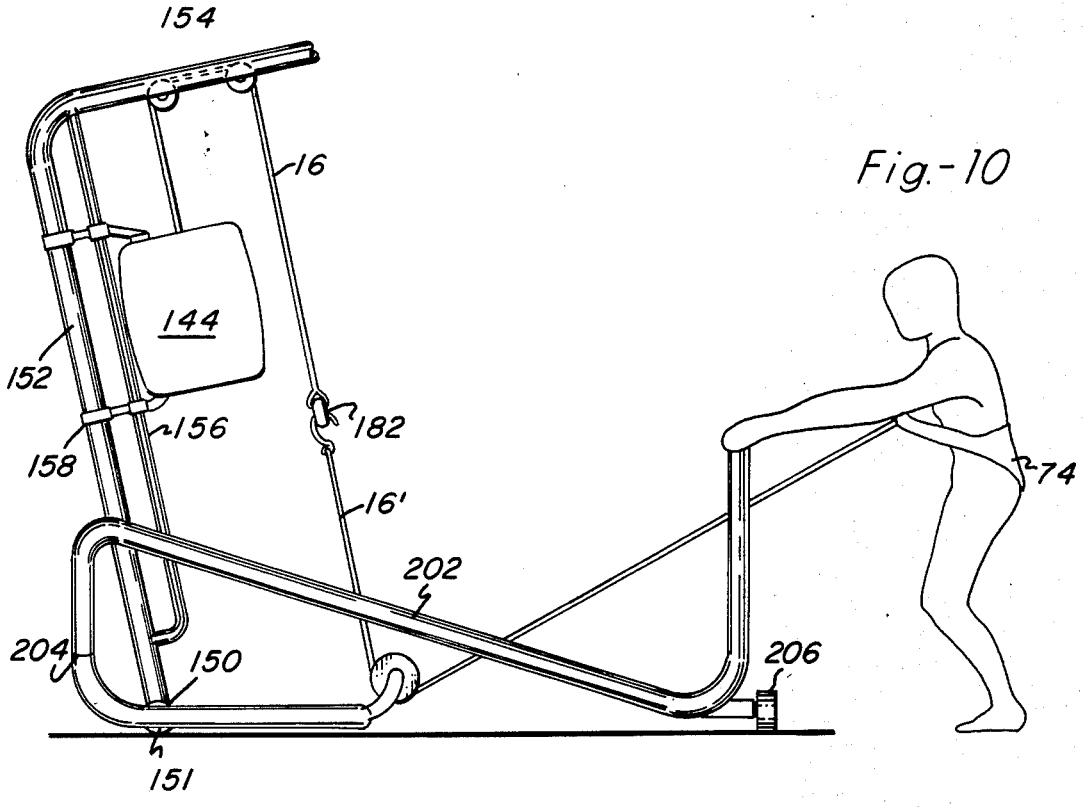
FIG. 10 is a view similar to FIG. 9, showing another position of the push-up exercise.
Figure 11:
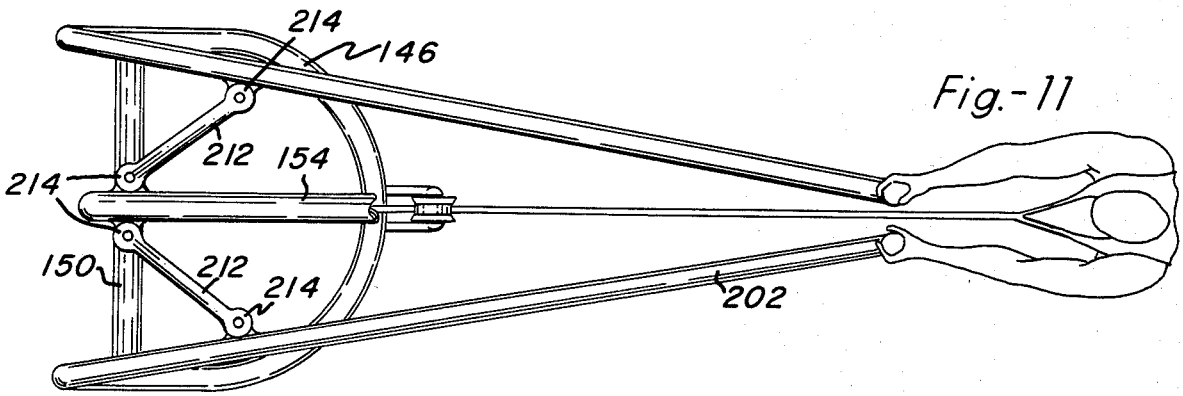
FIG. 11 is a top view of the embodiment of FIG. 10.

FIGS. 9–11 show the operation of the apparatus during a push-up movement. In the initial position of FIG. 9, the arms 202 are approximately parallel, and the weight container 144 is attached to the exercisor via a body harness. As the exercisor extends his arms in a pushing motion, he also brings his arms together, in turn bringing the spreadable arms 202 closer together at their front ends, as best shown in FIG. 11. Correspondingly, the spreadable arms act through the links 212 to push the upright member 152 rearwardly, from the pivot points 151, as best shown in FIG. 10. Thus, the upright tilts to the rear and raises the top bar above saddle 164.

Figure 13:
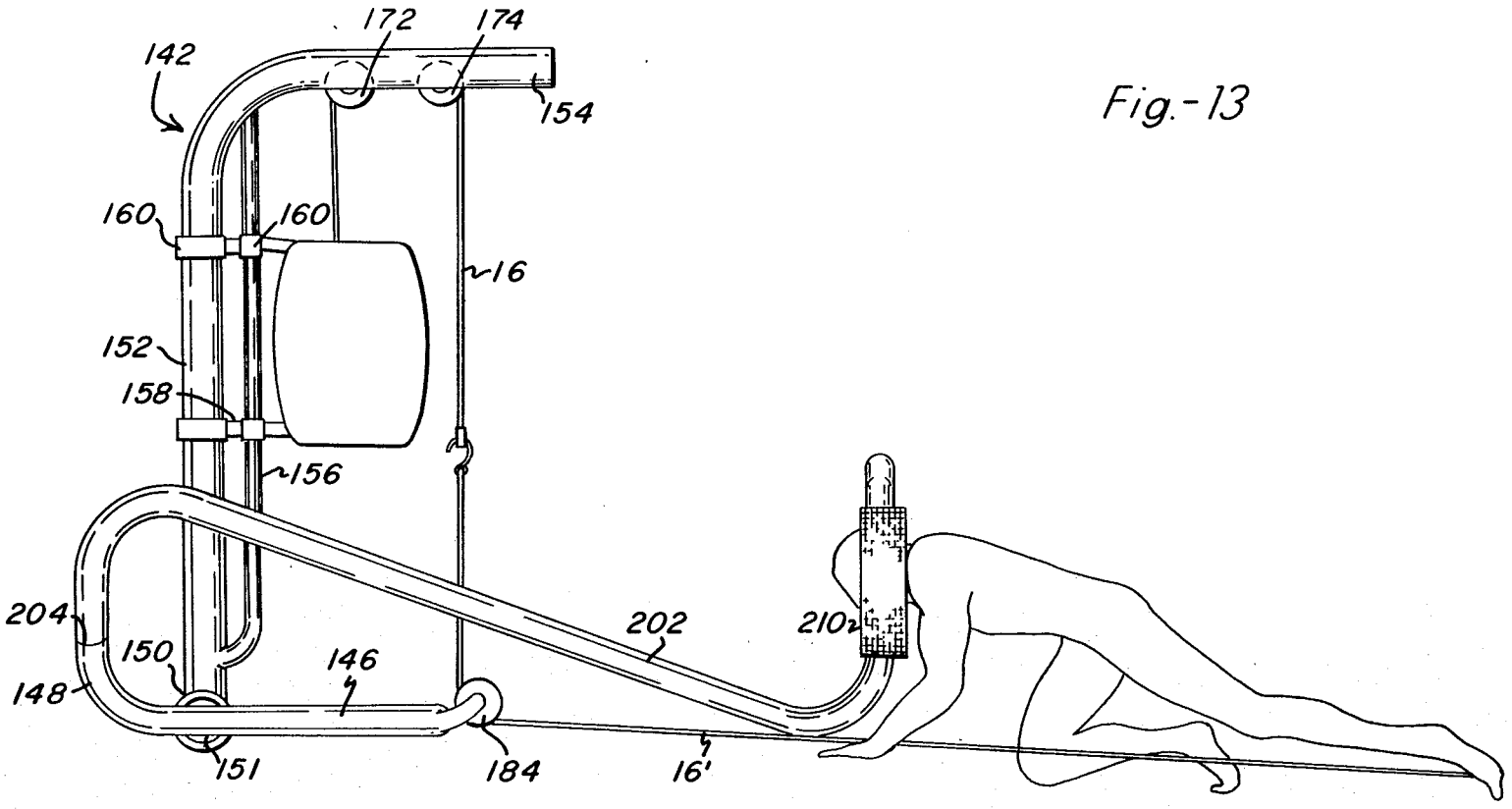
FIG. 13 is a side elevational view of the invention of FIG. 7, showing a leg extension exercise.

FIG. 13 shows a single leg extension movement wherein the pads 208 cushion the exercisor's shoulders while either leg exercises in a foot stirrup.

In all of the illustrated exercises, the weight in container 144 may be selected by the exercisor's operation of pump 108. The weight will decrease during the exercise as a portion of the fluid in the container drains back to reservoir 106, either by gravity drainage or by reverse operation of the pump. In addition, the support framework may be employed with other sources of weight, such as fixed weights.

I claim:

1. An exercise apparatus, comprising:

(a) a frame having a base portion and a superstructure including a tiltable portion thereof supported by the frame for hinged movement on a substantially horizontal axis, said tiltable portion including a top member extending over the base to support a weight therefrom;

(b) a weight;

(c) elongated, flexible suspension means connected to said weight and carrying the weight from said top member;

(d) a pair of laterally extending arms, each having a first end connected to the frame for hinged movement on a substantially vertical axis and each having a user engageable second end;

(e) guide means for directing said suspension means from said weight to a position for, in use, engagement by a user at the second ends of said arms for longitudinal movement; and (f) connecting means between said arms and said tiltable portion of the superstructure for causing the superstructure to tilt and raise said top member when the arms are moved together.

2. A weight lifting exercise device for user-selectively varying the quantity of dead weight being moved during the course of continued isotonic movement, comprising:

(a) free standing tank means adapted to contain, in use, a supply of liquid medium;

(b) a container defining a volume for receipt of liquid medium therein;

(c) frame means for supporting the container so as to permit user initiated vertical movement of said container with respect to the frame means;

(c) user engageable tensioning means connected to said container and carried by said frame means for, in use, permitting a user to move the container with respect to the frame means for performance of isotonic exercise movement;

(e) valve means for selectively increasing the weight of the container by selectively permitting the supply of liquid medium from said free standing tank means into the liquid receiving volume of said container;

(f) means for reducing the weight of the container during the course of, in use, continued isotonic movement by a user, by removing liquid medium from the container at a controlled rate; and (g) actuating means selectively operable by, in use, a user during the performance of continued isotonic exercise movement with the exercise device, for controlling said valve means to selectively permit the varying of the weight of the container.

3. The exercise device of claim 2, wherein said valve means comprises a pump communicating with the interior of said tank means, and further comprising user activated actuating means for selectively operating said pump.

4. The exercise device of claim 3, wherein said pump actuating means comprises a switch communicating with and remotely located from said pump.

5. The exercise device of claim 2 wherein said container includes a liquid medium discharge and receiving port in the container below the top end thereof.

6. A weight lifting exercise device for varying the quantity of weight being moved during the course of continued isotonic movement, for use in combination with a source of liquid medium, comprising:

(a) a container defining a volume for receipt of liquid medium therein;

(b) frame means for supporting the container so as to permit user initiated vertical movement of said container with respect to the frame means;

(c) user engageable tensioning means connected to said container and carried by said frame means for, in use, permitting a user to move the container with respect to the frame means for the performance of isotonic exercise movement;

(d) means for selectively increasing the weight of the container by selectively supplying liquid medium from a source thereof into the liquid receiving volume of said container;

(e) means for reducing the weight of the container during the course of, in use, continued isotonic movement by a user, by removing liquid medium from the container at a controlled rate; and (f) actuating means selectively operable by, in use, a user, for selectively varying the weight of the container being moved.

7. The exercise device of claim 6 further comprising flexible, elongated conduit means connected between a source of liquid medium and said container for transmitting liquid to the container.

8. The exercise device of claim 6, wherein said actuating means comprises a switch adapted to be engaged by the user's hand, said switch being remote from the means for selectively increasing the weight of the container and remote from the means for reducing the weight of the container.

9. The exercise device of claim 8, wherein said means for selectively increasing the weight of the container and said means for reducing the weight of the container comprise pump means of the type permitting reverse flow of liquid therethrough when the pump means is idle and a conduit extending between the pump means and the container, said conduit also delivering liquid medium into the container when the pump means is actuated.

10. The exercise device of claim 9, wherein the source of liquid medium comprises a reservoir connected to said pump means.

11. The exercise device of claim 6, wherein said frame means comprises:

(a) a base supporting the frame means in substantially upright position; and (b) a superstructure extending above the base connected thereto for tilting movement about a generally horizontal axis.

12. The exercise device of claim 11, further comprising: a pair of spreadable arms for engagement at first ends thereof by a user during exercise and connected to said frame means remotely from said first ends for pivotal movement about generally vertical axes; and means connecting at least one of said arms to said superstructure for tilting the superstructure in response to pivotal movement of the arm.

13. The exercise device of claim 12, wherein said connecting means comprises a link having a pivot joint at its attachment to both the arm and the superstructure.

14. The exercise device of claim 12, wherein: said superstructure comprises an upright member connected to the base at its lower end, and a top bar connected to the upper end of the upright member and extending generally laterally therefrom and over a portion of the base; and said base comprises a platform portion underlying at least a portion of the top bar, and a top bar support arm connected to the platform portion and vertically supporting the top bar at a location remote from the connection of the top bar to the upright member; and further comprising container support means suspending said container from the top bar between the upright member and top bar support arm.

15. The exercise apparatus of claim 14, wherein said top bar support arm comprises resting means at the upper end thereof for receiving said top bar in resting relationship abutting the top of the support arm for permitting the top bar to be lifted therefrom.

16. The exercise apparatus of claim 15, wherein said resting means comprises a saddle.

17. The exercise device of claim 11, wherein said superstructure comprises at least two generally vertical members, and said container comprises at least one container guide arm engaging at least one of said vertical members for guiding the container during exercise movement.

18. The exercise device of claim 17, wherein one of said at least two vertical members comprises an upright member connected to the base at its lower end, and the other of said at least two vertical members comprises a container guide rail spaced from and parallel to the upright member for at least a portion of the guide rail length.

19. The exercise device of claim 19, wherein said at least one container guide arm engages both vertical members.

20. The exercise apparatus of claim 6, further comprising suspension means connecting said container to the frame means for vertical movement at greater than one-to-one mechanical advantage.

21. The exercise apparatus of claim 6, further comprising:

(a) a pair of arms having first ends engageable by a user and second ends connected to said frame means, said arms extending in a generally horizontal direction from the frame means and terminating in approximately upstanding first ends;

(b) pad means carried on said upstanding first ends for supporting shoulder pressure from a user;

(c) elongated flexible suspension means connected at one end thereof to said container for vertically moving the container with respect to the frame means and having a foot-engageable connection on the other end thereof; and (d) guide means suitably supporting the suspension means for use in leg extension exercises by a user resting his shoulders against said pad means and engaging said foot-engageable connection with at least one foot.

22. The exercise apparatus of claim 21, wherein said pad means extend eccentrically from said upstanding arm first ends, further comprising means for pivoting the pad means about the first ends.

23. The exercise apparatus of claim 6, further comprising:

(a) a pair of substantially oppositely directed arms connected to said frame means near the top thereof for use by a user standing therebelow;

(b) elongated flexible suspension means connected at one end thereof to said container for vertically moving the container with respect to the frame means and having hand engageable means on twin opposite ends thereof, one of said twin ends being associated with each of said arms; and (c) guide means suitably supporting the suspension means for use in exercise wherein the hand engageable means are pulled together and downwardly from opposite locations on said arms by a user.

24. A weight lifting device for varying the quantity of weight being moved by a user during isotonic exercise comprising:

a container defining a liquid receiving volume;

frame means for supportng said container for upward and downward movement;

user engageable tensioning means for connection to said container so as to permit the user to move the container with respect to the frame means and carry out isotonic exercise;

weight increasing means for selectively increasing the weight of said container by selectively supplying liquid medium from a source thereof to the liquid receiving volume of said container, said weight increasing means including first actuating means for controlling said weight increasing means to selectively supply liquid medium to the liquid receiving volume of said container; and weight decreasing means for removing liquid from the liquid receiving volume of said container during the course of continued isotonic exercise to reduce the weight being moved during such exercise, said weight decreasing means including second acutating means for controlling said weight decreasing means to selectively remove liquid medium from the liquid receiving volume of said container;

said first and second actuating means comprising user operated switch means for selectively permitting the supply of liquid medium to, and removal of liquid medium from, the liquid receiving volume of said container to vary the weight of the container being moved.

25. The weight lifting apparatus of claim 24 in which said weight decreasing means includes means for automatically removing liquid from the liquid receiving volume of said container during the course of continued isotonic movement to reduce the weight of the container being moved during such exercise.

* * * * *

UNITED STATES PATENT AND TRADEMARK OFFICE

CERTIFICATE OF CORRECTION

PATENT NO. : 4,531,727

DATED : July 30, 1985

INVENTOR(S) : John H. Pitre

It is certified that error appears in the above-identified patent and that said Letters Patent is hereby corrected as shown below:

Column 2, line 7, "fo" should be --for--.

Column 3, line 6, "if" should be --is--.

Column 5, line 32, "furture" should be --future--.

Column 10, line 54, "168" should be --186--.

Column 12, line 24, "(c)" should be --(d).

Column 14, line 18, "claim 19" should be --claim 18--.

Column 14, line 67 "supportng" should be --supporting--.

Signed and Sealed this

*Twelfth* Day of *November 1985*

[SEAL]

*Attest:*

*Attesting Officer*

DONALD J. QUIGG

*Commissioner of Patents and Trademarks*